United States Patent [19]

Bernhardt et al.

[11] Patent Number: 4,682,643

[45] Date of Patent: Jul. 28, 1987

[54] METHOD OF PRODUCING MOLDED PARTS AND CASTING PATTERN THEREFOR

[75] Inventors: David L. Bernhardt, Canton, Mich.; Neno T. Nenov, Williamsville, N.Y.

[73] Assignee: Nu Con Corporation, Livonia, Mich.

[21] Appl. No.: 783,761

[22] Filed: Oct. 3, 1985

Related U.S. Application Data

[63] Continuation-in-part of Ser. No. 543,775, Oct. 20, 1983, abandoned.

[51] Int. Cl.[4] ..... B22C 9/04

[52] U.S. Cl. ..... 164/34; 164/35; 164/44; 164/45; 264/226; 264/227

[58] Field of Search ..... 164/34, 35, 36, 44, 164/45, 246, 249; 264/221, 225, 226, 227

[56] References Cited

U.S. PATENT DOCUMENTS

| | | | |
|---|---|---|---|
| 3,313,637 | 4/1967 | Schneider | 164/35 |
| 3,426,834 | 2/1969 | Jacobs et al. | 164/45 |
| 3,428,725 | 2/1969 | Delmonte et al. | 264/227 |
| 3,616,841 | 11/1971 | Walz | 164/34 |
| 3,635,280 | 1/1972 | Parsons | 164/246 |
| 3,766,969 | 10/1973 | Mezby et al. | 164/34 |
| 3,848,654 | 11/1974 | Boyle et al. | 164/34 |
| 4,499,940 | 2/1985 | Hall | 164/45 |
| 4,518,288 | 5/1985 | Cilindro | 164/45 |

FOREIGN PATENT DOCUMENTS

| | | | |
|---|---|---|---|
| 51-4167 | 2/1976 | Japan | 164/45 |

*Primary Examiner*—Nicholas P. Godici
*Assistant Examiner*—Richard K. Seidel
*Attorney, Agent, or Firm*—Krass & Young

[57] ABSTRACT

An investment casting process employs a low-cost plastic pattern manufactured by machining. A mold is cast around the plastic pattern following which the pattern is removed from the mold to leave a mold cavity which molten metal or the like may be poured to produce a finished part. Reusable plastic patterns may be formed by casing silastic rubber. The silastic rubber patterns may be mechanically separated from the mold without damaging the pattern.

8 Claims, 6 Drawing Figures

METHOD OF PRODUCING MOLDED PARTS AND CASTING PATTERN THEREFOR

RELATED APPLICATION

This application is a continuation-in-part application of U.S. Ser. No. 543,775, filed Oct. 20, 1983, now abandoned, entitled "Method of Producing Molded Parts and Casting Pattern Therefor."

DESCRIPTION

1. Technical Field

The present invention broadly relates to a process for molding parts, and deals more particularly with investment casting in which a pattern corresponding to the geometry of the part is used to create a mold in which the part is cast.

2. Background Art

Investment casting is an industrial process which employs a disposable pattern that is used to produce a mold in which parts can be cast. The pattern is made by injecting wax or plastic into a die which has been manfuactured by machining processes. These dies may range from a simple hand operated, single cavity tool to a fully automated multi-cavity tool depending on production quantities and the complexity of the part.

The pattern is heat disposable and is melted out after the mold is made. The pattern possesses the exact geometry of the required finished part, but is made slightly larger to compensate for volumetric shrinkage which occurs during production of the pattern and the solidification of metal in the mold when cooling down to room temperature. Volumetric shrinking may occur during the pattern production stage because of the lack of dimensional stability, and because the material employed to produce the pattern has a tendency to shrink in the pattern die when it is transformed from a liquid to solid state.

Following manufacture of a pattern, the mold is made by one of several processes, depending upon the type of alloy to be poured. For example, in the case of ferrour alloys, the pattern is dipped into a ceramic slurry and then drained and stuccoed with fine ceramic sand. This step is usually repeated several times (10–20 layers are not uncommon) after the first coating is dry. The pattern is then placed in an open ended metal can which is filled with a coarse slurry of ceramic back-up material which eventually hardens to form a mold. The pattern encased by the mold is then placed into a furnace or autoclave causing the wax or plastic pattern to flash-up or melt and run out of the mold. Melting of the pattern leaves a cavity in the mold corresponding exactly in shape and dimension to the final part with the exception that the overall geometry of the cavity is larger than the desired final part due to the additional stock required for finish machining of the part and due to the volumetric and solidification shrinkage of the metal. The mold is sometimes fired to burn out the last traces of pattern material before it can be filled with metal. This firing process proceeds slowly in a controlled cycle which may stretch over 12 to 18 hours to avoid cracking of the mold. Following firing, molten metal may be introduced into the mold cavity after which the molten metal is allowed to cool and harden. After hardening, the ceramic mold is broken away to release the finished part.

The process described above is relatively expensive in terms of the tooling which is required to make the dies used in forming the pattern. Consequently, the prior art process is impractical for use in a relatively small run of parts.

Even in larger part runs, the prior process is expensive because it may be necessary to prepare several sets of pattern dies having varying dimensions. This is because the amount of oversize of the pattern (and thus of the die) which is necessary to allow for shrinkage must be determined empirically by producing a number of the patterns until the proper size is determined to achieve the final part dimensions. The problem of shrinkage is particularly severe in connection with some molding materials such as powdered metal where shrinkage may amount to 35 percent or more.

In view of the foregoing, it would be advantageous to provide a process for producing the pattern which eliminates the expensive tooling and dies required to mold the pattern, while at the same time eliminating variation in the final part geometry caused by shrinkage of the pattern. A process possessing these advantages would allow economical casting of small quantities of parts and those formed from material such as powdered metal having a high shrinkage factor.

It would also be advantageous to provide a casting process in which the pattern is reusable to make a plurality of molds.

BRIEF SUMMARY OF THE INVENTION

In accordance with the present invention, a process is provided for molding parts using an investment casting technique in which the pattern is economically produced without the need for dies and in which the pattern may be reused if desired to produce multiple molds.

According to one aspect of the invention a blank of plastic material, such as a cross-linked polystyrene, a machinable wax, or a high density urethane foam, is machined into a pattern shape having dimensions substantially corresponding to that of the final part. The final pattern may comprise a single unitary machined piece or may comprise an assembly formed from several separately machined pieces. For example, the hub and blading of an impeller may be formed as one piece and a shroud for the impeller may be formed as a separate piece whereafter the two pieces may be joined by gluing or otherwise to form the completed impeller assembly. Other materials such as molding wax may be used to smooth out joints in the assembly, to provide corner fillets or to build up wall thicknesses. After the pattern has been machined, ceramic slurry is applied to the surface of the pattern by dipping or other means, thereby encasing the pattern and forming a mold body. After the mold body has hardened, the pattern is removed either by heating the mold to combust the pattern or by dissolving the pattern using a solvent. The resulting mold cavity possesses dimensions substantially identical to those of the part to be molded since shrinkage of the pattern does not occur.

In accordance with another aspect of the invention, multiple molds may be produced using a resuable pattern formed of silastic rubber. The resuable pattern is formed by machining a blank of plastic material such as urethane foam or cross-linked polystyrene into a shape having dimensions corresponding to that of the part to be molded. Epoxy is then cast around the machined plastic pattern and allowed to cure to form a mold body or negative. The plastic pattern is dissolved using a solvent, leaving a mold cavity into which a thermo-setting silastic rubber is poured. Alternatively, the plastic pattern may be broken loose from the mold cavity and emptied out of the mold cavity. The silastic rubber is allowed to set up, thereby forming a pliable, resilient rubber pattern which can be mechanically pulled away from the epoxy mold. Low density ceramic or plaster is then cast around the rubber pattern following which the pattern is separated from the ceramic mold by pulling it from the mold cavity. The resulting ceramic mold may be employed to cast metal parts or additional plastic patterns. The rubber pattern may be reused to produce additional ceramic molds.

BRIEF DESCRIPTION OF THE DRAWINGS

In the drawings, which form an integral part of the specification and are to be read in conjunction therewith, and in which like reference numerals are employed to designate identical components in the various views.

DETAILED DESCRIPTION OF THE PREFERRED EMBODIMENT

The present invention relates to a process for molding parts and patterns using an investment casting technique. The process utilizes a disposable or reusable plastic pattern for making a mold used in powered metal and hot isostatic pressing and casting, precipitate hardening stainless steels, titanium alloys, high temperature alloys, tool steels, high strength alloys, refractory alloys and aluminum alloys.

Figure 1:
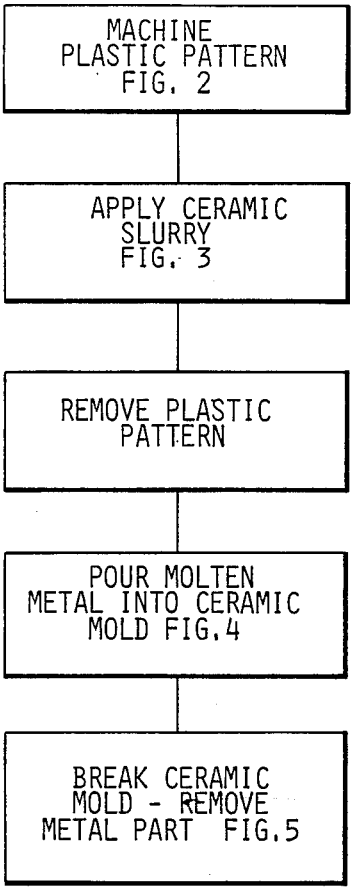
FIG. 1 is a flow chart for one of the processes of the present invention.
Figure 2:
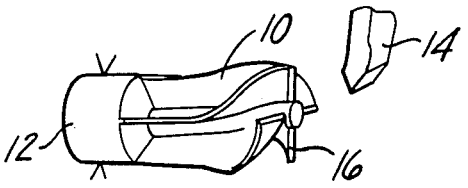
FIG. 2 is a perspective view of a plastic pattern used in the process shown in FIG. 1.
Figure 3:
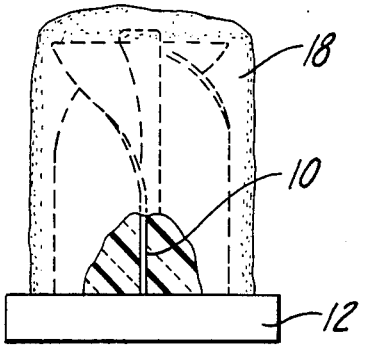
FIG. 3 is an elevational view of the ceramic mold, parts being broken away to show the position of the plastic pattern therewithin.
Figure 4:
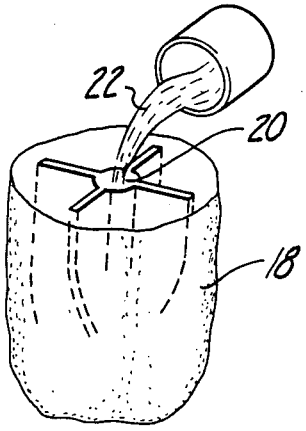
FIG. 4 is a perspective view of the mold shown in FIG. 3 after removal of the pattern, showing the introduction of molten casting material to the mold cavity.
Figure 5:
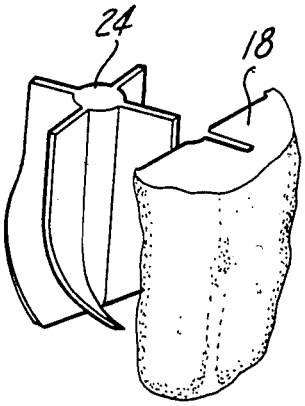
FIG. 5 is a perspective view of the finished, cast part being removed from the mold.

Referring to the drawings, according to one aspect of the invention, a process is provided for forming a plastic pattern 10 which is employed in an investment casting technique to produce a cast part 24. As indicated in FIG. 1, the first step in the process consists of machining a blank of plastic material, with a machine tool 14 of the like, to a shape having a geometry and dimensions sustantially identical to those of the finished part 24. As particularly shown in the drawings, the part 10 may comprise an impeller, by way of example, having impeller blades 16 which are curved in two dimensions. The pattern 10 may be mounted on a base 12 during the machining process.

The blank of plastic material from which the pattern 10 is machined preferably comprises a cross-linked polystyrene plastic. This material has been found to possess superior dimensional stability and is therefore quite suitable for finished parts having dimensions with closely controlled tolerances. However, other plastic materials may be employed and in fact cellular plastic material, such as polyurethane foam, may also be employed where the dimensional tolerances of the finished part are not as critical. Softer, cellular plastic material is less desirable for use in casting close tolerance parts because the blank from which the plastic pattern is machined may tend to deflect somewhat during the machining process. In any event, the plastic pattern 10 may comprise any of various thermosetting plastics. However, styrenes are preferred because they possess relatively low ash content after undergoing combustion in a later discussed step in the inventive process.

After machining the plastic pattern 10, a slurry of ceramic is applied to the outer surface of the pattern 10 as by repeatedly dipping the pattern 10 in a reservoir of such slurry. The successive layers of the ceramic slurry applied to the pattern 10 are allowed to dry, thereby encasing the pattern 10 in a ceramic mold 18.

The next step in the process involves removing the plastic pattern 10 from the mold 18 to produce a mold cavity 20 corresponding in shape and dimensions of the final part 24. Pattern removal may be accomplished mechanically, thermally or chemically. In the case of patterns 10 having geometries which allow mechanical separation of the pattern 10 from the mold 18 without applying stress to the mold 18, the pattern 10 may be coated with a conventional mold release material before ceramic slurry is applied, thus allowing the pattern 10 to be axially removed from the end of the mold 18. However, in the case of patterns 10 having geometries which would preclude axial separation of the pattern 10 from the mold 18, such as the impeller shown in the drawings, it is necessary to remove the pattern 10 thermally or chemically. Thermal pattern removal is effected by placing the ceramic mold having the pattern therein into an oven or autoclave having a temperature sufficient to combust or melt away pattern 10, thus transforming the solid plastic pattern into a gas or liquid, which is drained away. Depending upon the type of plastic or foam being employed, this approach may be somewhat undesirable in some cases because of residue, normally in the form of ash, left within the mold cavity after burnout of the pattern. As previously indicated, ash residue may be minimized by employing a styrene plastic.

Alternatively, the pattern 10 may be chemically removed from the mold 18 by dissolving the pattern by using a solvent. For example, toluene methene-clorides are suitable solvents for cross-linked polystyrene.

After removing the pattern 10 from mold 18, flowable molding material 22 is introduced into the cavity 20. The molding material may consist of molten steel or powdered metal which is then isostatically pressed to form the finished part 24. After the molding material 22 has cooled and hardened to form the finished part 24, the mold 18 is broken or fractured in order to release the finished part 24.

The process described above has been found to be highly economical and effective in producing a finished part having dimensions within narrow design tolerances. Since the plastic pattern is dimensionally stable, shrinkage thereof is precluded and a finished part corresponds closely in terms of dimensions to that of the pattern.

Figure 6:
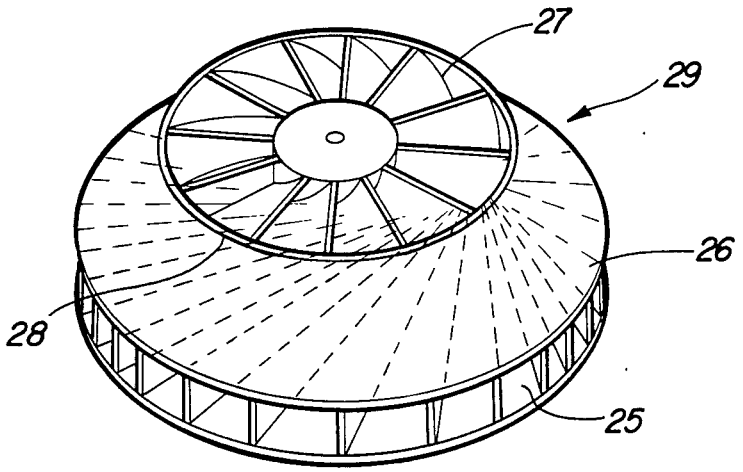
FIG. 6 is a perspective view of an assembled pattern formed from a plurality of separately machined pieces.

In the embodiment of the invention seen in FIG. 6, the pattern 29 is assembled from a plurality of separate parts. Specifically, a shrouded impeller is seen in FIG. 6 comprising a hub and blading 25 machined from plastic in one piece, and a shroud 26 machined in plastic as another separate piece. The pieces, after being separately machined, are joined together along each blade edge and are provided with corner fillets 27 along the edges of the blades by the use of molding wax. The molding wax is also employed to build-up the wall thickness 28 of the completed impeller pattern. The composite pattern 29 is then employed in the process of FIG. 1 to produce a shrouded impeller part.

According to another aspect of the invention, a process is provided for producing reusable patterns, in distinction to the process for producing disposable plastic patterns described immediately hereinabove. The first step in this alternative process consists of machining the plastic pattern 10 as described hereinabove. After machining the plastic pattern 10 to substantially the final size of the part 24, a quantity of uncured epoxy is cast around the pattern 10 and allowed to cure, thereby forming a hard epoxy mold. The pattern is then removed from the epoxy mold by dissolving the pattern using a suitable solvent which is introduced into the mold cavity. After chemically removing the pattern, a quantity of flowable silastic rubber is poured into the cavity of the epoxy mold following which the rubber is allowed to cure and set up. As used herein, the term silastic rubber is defined as a silicone based synthetic rubber. Curing of the silastic rubber creates a deformable, resilient rubber pattern which then can be removed from the epoxy mold by forcibly pulling the rubber pattern out of the mold cavity. With the rubber pattern removed from the epoxy mold, a quantity of low density ceramic material or plastic is cast around the rubber pattern and is then allowed to harden. After the ceramic mold has been cured, the resilient, deformable pattern is mechanically removed from the ceramic mold by simply pulling the pattern axially out of the mold cavity. At this point, the resultant ceramic mold may be employed to cast metal parts or further plastic patterns which in turn may be employed to produce additional molds in which metal parts are cast. The silastic rubber pattern may then be used to form additional ceramic molds as described above.

From the foregoing, it is apparent that the novel processes described above not only provide for the reliable accomplishment of the objects of the invention, but do so in a particularly effective and economical manner. It is recognized, of course, that those skilled in the art may make various modifications or additions to the preferred embodiments chosen to illustrate the invention without departing from the spirit and scope of the present contribution of the art. Accordingly, it is to be understood that protection sought and to be afforded hereby should be deemed to extend to the subject matter claimed and all equivalents thereof fairly within the scope of the present invention.

We claim:

1. A method of making a plurality of identical molded parts, comprising the steps of:

(a) forming a first plastic pattern corresponding to the shape and dimensions of said parts;

(b) encasing said first pattern in a first mold;

(c) removing said first pattern from said first mold to provide a mold cavity;

(d) charging said first mold with a quantity of flowable material which sets up to form a resilient, pliable second pattern;

(e) separating said second pattern from said first mold;

(f) forming a second mold by casting material around said second pattern;

(g) removing said second pattern from said second mold;

(h) charging said second mold with a quantity of molding material;

(i) breaking said second mold to remove the part molded therewithin; and (j) then, repeating Steps (f) through (i) to produce additional parts.

2. The method of claim 1, wherein Step (a) is performed by machining a blank of plastic material.

3. The method of claim 1, wherein Step (b) is performed by casting epoxy plastic around said first pattern.

4. The method of claim 1, wherein Step (c) is performed by subjecting said first pattern to a solvent in which said first pattern may be dissolved.

5. The method of claim 1, wherein Step (d) is performed by introducing a quantity of silastic plastic into the mold cavity of said first mold.

6. The method of claim 1, wherein Step (e) is performed by mechanically pulling said second pattern from the mold cavity in said first mold.

7. The method of claim 1, wherein Step (f) is performed by applying a ceramic slurry to the surface of said second pattern.

8. The method of claim 1, wherein Step (g) is performed by mechanically pulling said second pattern from said second mold.

* * * * *